United States Patent [19]

Walters

[11] 4,193,017

[45] Mar. 11, 1980

[54] GAS DISCHARGE DISPLAY PANEL

[75] Inventor: Frank Walters, Bury, England

[73] Assignee: Ferranti Limited, Hollinwood, England

[21] Appl. No.: 3,914

[22] Filed: Jan. 16, 1979

[30] Foreign Application Priority Data

Jan. 18, 1978 [GB] United Kingdom ..... 01929/78

[51] Int. Cl.[2] ..... H05B 37/00; H05B 39/00; H05B 41/00

[52] U.S. Cl. ..... 315/169.4; 315/169.2; 340/700; 340/716

[58] Field of Search ..... 315/169.2, 169.4; 340/700, 752, 716, 773, 774, 714

[56] References Cited

U.S. PATENT DOCUMENTS 3,242,378 3/1966 Kobayashi ..... 315/169.2

4,051,408 9/1977 Albertine et al. ..... 315/169.2

4,138,626 2/1979 Unotoro et al. ..... 315/169.4

*Primary Examiner*—Alfred E. Smith

*Assistant Examiner*—Robert E. Wise

*Attorney, Agent, or Firm*—Cameron, Kerkam, Sutton, Stowell & Stowell

[57] ABSTRACT

A d.c. gas discharge display panel consists of a rectangular array of discharge cells suitable for displaying alphanumeric characters surrounded by a circular array. The two arrays share one common set of conductors and are addressed sequentially by reducing the potential on the common conductors in turn by a glow transfer device extending around the circular array. The other conductors of the circular array may be commoned to result in a radial pointer whose position around the rectangular array can be changed.

7 Claims, 3 Drawing Figures

GAS DISCHARGE DISPLAY PANEL

This invention relates to a gas discharge display panel.

It is known to display alphanumeric data on a gas discharge display panel having a matrix of discharge devices at cross points of two orthogonal sets of conductors by sequentially addressing conductors of one set while selectively addressing conductors of the other set. When the panel is of the d.c. type it can be operated to retain the display by virtue of a maintaining voltage applied between the sets of conductors.

Such scanning is of interest in that it reduces the complexity of external address circuitry and co-pending application Ser. No. 860,638 discloses such a display panel. It is also known to display data in analog form, as represented by a marker on a circular dial, by forming the array as a circle with the orthogonal sets of conductors extending circumferentially and radially to the circle.

However it is frequently required to display the same, or complementary, information in both analog and digital form on the same display but where two such displays are merely combined in a single package the large number of external connections results in a complex construction.

It is an object of the present invention to provide a d.c. gas discharge display panel of simple construction for displaying information both in alphanumeric form and as a marker on a circular scale.

According to the present invention a d.c. gas discharge display panel comprises a block of electrically insulating material having a plurality of gas filled cells arranged in a rectangular first array surrounded by a plurality of cavities arranged in a second array of concentric circles, each of the cells of the first array having an electrode at one end thereof connected by an individual resistor to one of a set of first conductors extending along one co-ordinate of the first array and each cell of the second array having an electrode at said one end connected by an individual resistor to one of a set of concentric second conductors, a set of third conductors extending across the other ends of the cells of the second array orthogonally to the second conductors to form second electrodes for the cells of the second array, at least some of the third conductors extending across the first array orthogonally to the first set of conductors to connect to, or form, second electrodes for the cells of the first array, said third conductors being joined by way of resistors to a common conductor, and a glow transfer device comprising a further concentric circle of gas filled cells each having a pair of transfer electrodes in contact with the discharge gas, the first transfer electrode of the pair for each cell being connected to, or comprising, one of the third conductors, and the second transfer electrode being connected to other second transfer electrodes to form groups of equal numbers, corresponding electrodes in each group being connected to a transfer conductor extending concentrically of the cells such that repetitive energisation of each transfer conductor in turn causes a discharge formed in one glow transfer cell to move around the circle by the mechanism of glow transfer changing the potential of each third conductor in turn to cause striking or extinguishing of discharges in cells of the first or second array addresed contemporaneously by way of the first or second conductors respectively.

An embodiment of the invention will now be described by way of example with reference to the accompanying drawings, in which.

Figure 1:
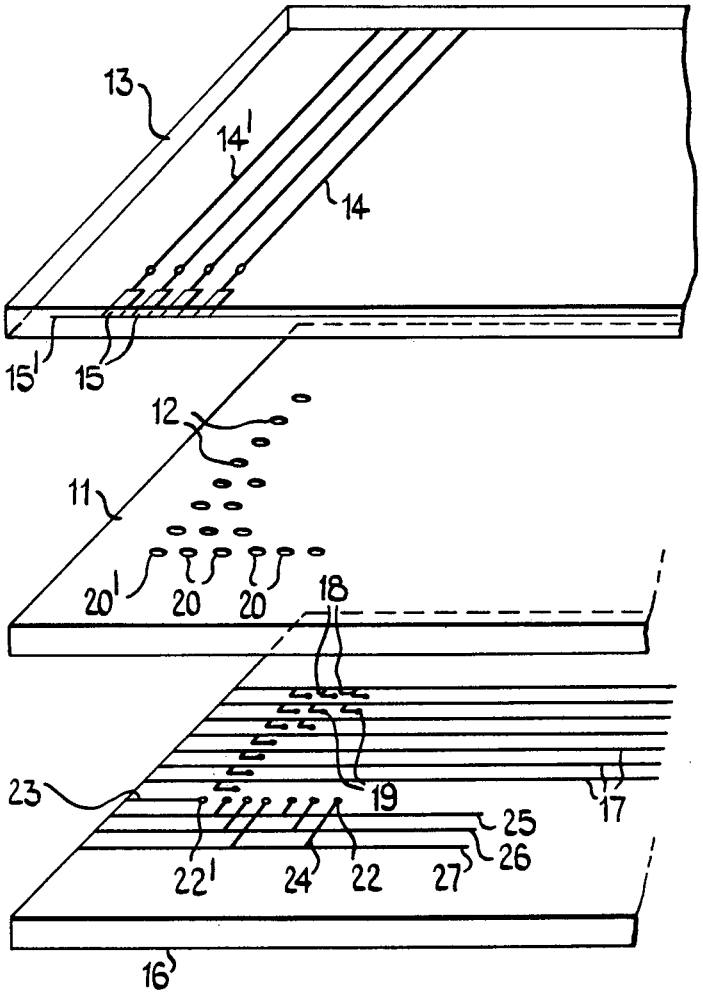
FIG. 1 is an exploded perspective view of a d.c. gas discharge display panel with a rectangular array of cells to illustrate the principle of glow transfer.

Referring to FIG. 1 a gas discharge display panel comprises a block 11 of electrically insulating material containing a two-coordinate array of cavities 12 in the form of through apertures. A plate 13 of transparent material, adapted to abut one face of the block 11 and to close off one end of the apertures 12, carries a first set of conductors 14 on the face adjacent the block 11 and arranged such that each conductor overlays the ends of all the apertures extending along one value of one coordinate of the array, for example, columns. The column conductors 14 of the first set are hereafter also called the cathode conductors as the panel will be described with them in this role. Each cathode conductor is connected by way of a resistor 15, also carried by the plate 13, to a common conductor 15'. A plate 16 also of electrically insulating material is adapted to abut the opposite face of the block 11 and to close off the other ends of the apertures to form cells. The face of the plate 16 adjacent the block 11 carries a second set of conductors, anode conductors 17, extending orthogonally to the cathode conductors, that is, along rows of the array. To each anode conductor is connected a plurality of resistive elements 18 each contacting an anode electrode 19 co-operating with the end of an aperture of that row. The plates 13 and 16 are sealed to the block 11 around their edges to enclose a discharge gas of suitable composition and pressure, the gas being free to permeate between cells.

A glow transfer device comprises a plurality of discharge cells formed by apertures 20 in the block 11 which extend in a row parallel to the anode conductors 17. The apertures 20 are of the same dimensions and spacing as the apertures 12 such that the cathode conductors 14 each lie over one end of an aperture 20. Each overlying portion of the cathode conductors is plated to provide a first transfer device. The plate 16 carries a row of second transfer electrodes 22 individual ones co-operating with the other ends of the apertures 20. The first discharge cell of the row at which the transfer glow commences, that is at the left hand end as seen in the Figure, is called a reset cell 20' and the transfer electrode 22' of the reset cell is connected to a unique transfer conductor 23, the reset transfer conductor. The other transfer electrodes 22 are arranged in groups of three, corresponding electrodes of each group being connected by links 24 to one of transfer conductors 25, 26 or 27. The transfer conductors extend parallel to the anode conductors 27 and the links 24 extend parallel to the cathode conductors 14. The cells of the glow transfer device serve to confine the glow discharge between each pair of electrodes but the discharge gas is able to communicate between adjacent cells for the purpose of priming on which the mechanism of glow transfer depends.

In operation in a simple selective write mode the conductor 15' is maintained at earth potential and the conductors 17 are all maintained at a potential $V_m$ such that the potential difference across the cavities 12 is sufficient to maintain a discharge struck in any of the cells but insufficient to cause one to strike. The conductors 25, 26 and 27 are connected to a three phase pulse source which applies a negative going pulse to each conductor in turn repetitively. A discharge can be struck in any cell by the application of a voltage across it not less than $V_s$, greater than $V_m$.

To produce a display a negative going pulse is applied to the reset conductor 23 of such value to strike a discharge in the reset cell 20'. The effect of the discharge is to apply a negative potential to the electrode 21 taking the potential of the cathode conductor negative by an amount arranged to be $V_p$. If at this time positive going pulses $V_p$ are applied to selected anode conductors 17 then a voltage of $V_m+2\ V_p\ (>V_s)$ will exist across the cells associated with the selected anodes and discharges will be struck in those cells.

In other cells common to these anode conductors the voltage $V_m+V_p$ is insufficient for discharges to strike.

When the pulse is removed from the conductor 23 and a pulse applied to the conductor 25 a discharge forms in the cell adjacent to that previously containing a discharge in preference to any others connected to the conductor 25. Simultaneous raising of the potential of selected conductors 17 causes striking of discharges in cells associated with the selected anode conductors and the cathode conductor of the second cell of the glow transfer device. This process is repeated along the transfer device.

To erase a display the voltage across a cell containing a discharge must be reduced below $V_e$ (where $V_m-2V_p<V_e<V_m-V_p$). The glow transfer device is operated with pulses of opposite polarity, that is, positive going, such that the potential of the second transfer electrodes 22 is increased by $V_p$ and that of the anode conductors is reduced to $V_m-V_p$. The cells associated with other column conductors of the discharge device are unaffected whereas those associated with the column conductor for which a transfer discharge exists have a voltage across them reduced to $V_m-2\ V_p$ and are extinguished.

By employing the row of cavities 20 as the discharge space of the glow transfer device it can be made small in relation to the remainder of the panel.

Figure 2:
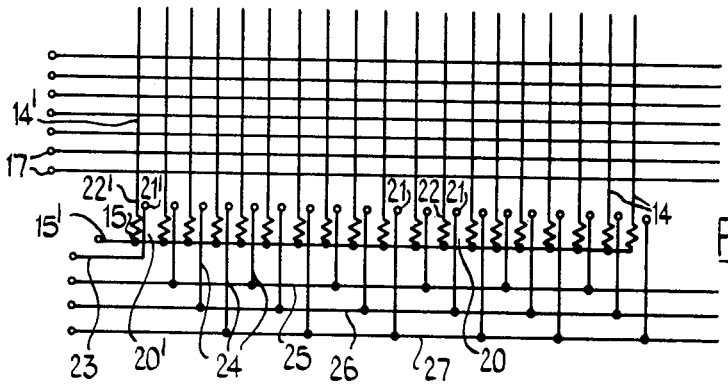
FIG. 2 is a schematic plan view of the panel of FIG. 1 also to illustrate the principle of glow transfer.
Figure 3:
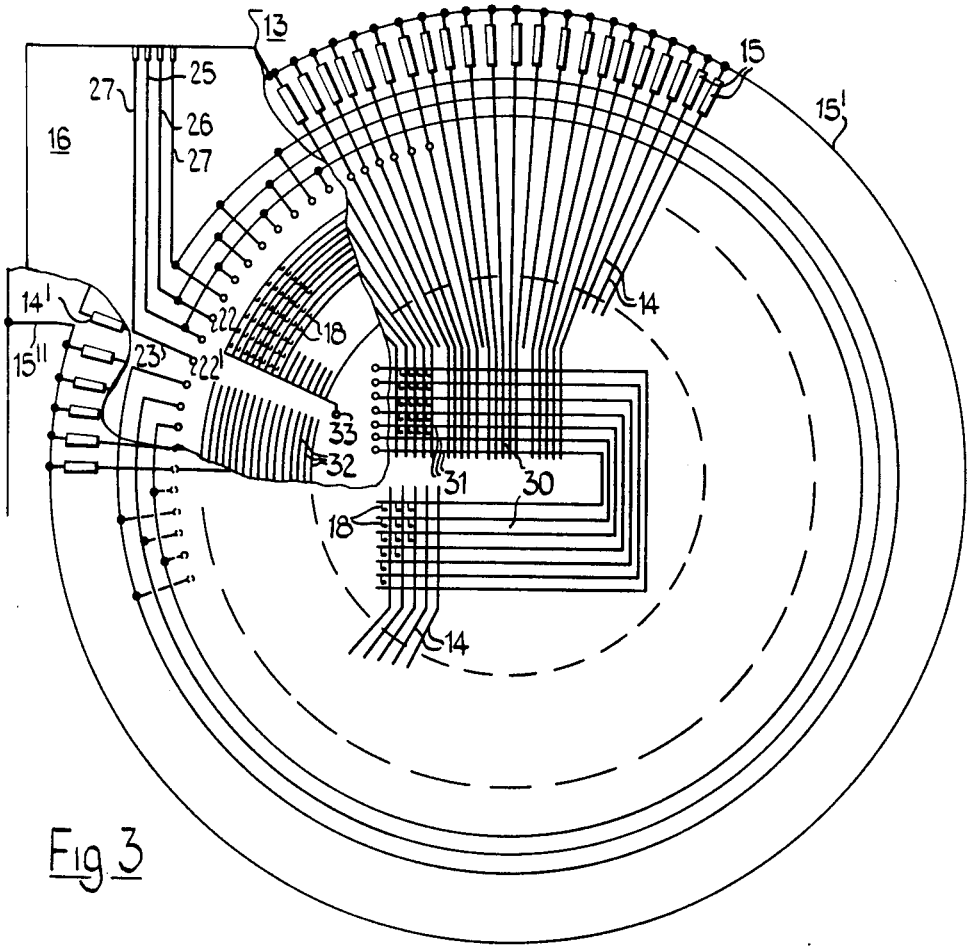
FIG. 3 is a partly fragmented plan view of a combined analog and alphanumeric display panel according to the present invention.

Referring now to FIG. 3 a plan view similar to FIG. 2 is shown and parts common to both have like reference numerals.

This comprises a first, rectangular, array 30 comprising a set of N(=7) first, or anode, parallel conductors 31 folded to be able to display two rows of alphanumeric characters, and a second, circular array surrounding the first, comprising a set of second, anode, conductors 32 arranged in concentric circles. All of the anode conductors 32 are connected to each other at one point and connected to an anode terminal 33. Surrounding the anode conductors 32 are a plurality of transfer electrodes 22 of the glow transfer device connected in groups of three to concentric transfer conductors 25, 26 and 27. All of these conductors are in one plane on one face of an electrically insulating first end plate 16 at one end of cavities in an electrically insulating spacer block (not shown) which defines the discharge cells.

Adjacent the other ends of the cavities are conductors 14, cathode conductors, of a third set each connected by way of a resistor 15 to a common conductor 15' extending circumferentially of the display. The conductors 14 extend radially across the circular part of the display, orthogonally to the anode conductors 32, and some extend to comprise also cathode conductors for the first array, extending orthogonally to the anode conductors 31. The conductors which extend to the first array are in groups of n(=5) adjacent conductors effectively dividing the first array into sub-arrays of 7×5 cells suitable for displaying alphanumeric characters. The groups of n conductors are equally spaced around the device.

The circle of transfer electrodes is broken at one point by a reset conductor and electrode 23, 22' cooperating with a cathode conductor 14' connected to the terminal 15''. The conductors 14, resistors 15, and common conductor 15' are formed on the face of a second end plate of electrically insulating material.

In operation when information is to be displayed the reset conductor 23 is energised to initiate a transfer glow and by sequential energisation of the transfer conductors, 25, 26 and 27 the glow is stepped around the circle of cells until the reset cell is reached. If the information is to be retained unchanged the transfer glow is stopped. If information is to be changed in some way the reset conductor is again energised and glow transfer initiated.

It will be appreciated that as the final transfer cell is adjacent the reset cell it should be in a different group from the first transfer cell to ensure that the glow transfers in the correct direction.

All the anode conductors 32 are connected together (to terminal 33) so that when they are energised at a suitable point during the scan of the transfer glow a pointer in the form of a radial line will be displayed at the relevant angular position.

During the sweep, at times corresponding to a reduction of potential on the cathode conductors serving the rectangular array, selected ones of the anode conductors 31 are addressed in turn in synchronism with the cathode conductors having potential changed to write up an alphanumeric display. The storage property exhibited by the d.c. panel ensures that the display remains even when cathodes associated with the rectangular array are not subjected to voltage change by the glow transfer device.

All the electrodes 32, when connected together, form a line pointer. It will be appreciated that the conductors 32 may be connected in groups comprising alternate circles, and the cells associated with those circles provided with a phosphor of a particular colour so that different coloured lines are produced.

Alternatively all of the conductors 32 could be connected to inidividual connections such that different numbers of pins could be energised to provide a pointer whose length can be made to vary as well as its angular position.

Furthermore each discharge of the circular array could be retained after striking to provide a display which comprises and illuminated segment of the circle, the angle occupied by the segment or its rate of growth being representative of some event to be displayed.

Depending upon the size of the first array and the purpose to which it is put the array may be formed with or without gaps between each group of cathode conductors 14 which extend across the array. As illustrated in FIG. 3 gaps may be left between groups of cathode conductors, such as by not extending all of the radial conductors, to make the first array suitable for displaying alphanumeric characters. Alternatively, all, or as many as possible, of the first radial conductors may extend across the first array to make it also suitable for non-alphanumeric displays such as graphic representations.

What we claim is:

1. A direct current gas discharge display panel comprising a block of electrically insulating material having a plurality of gas filled cells arranged in a rectangular first array surrounded by a plurality of cavities arranged in a second array of concentric circles, each of the cells of the first array having an electrode at one end thereof connected by an individual resistor to one of a set of first conductors extending along one co-ordinate of the first array and each cell of the second array having an electrode at said one end connected by an individual resistor to one of a set of concentric second conductors, a set of third conductors extending across the other ends of the cells of the second array orthogonally to the second conductors to form second electrodes for the cells of the second array, at least some of the third conductors extending across the first array orthogonally to the first set of conductors to connect to, or form, second electrodes for the cells of the first array, said third conductors being joined by way of resistors to a common conductor, and a glow transfer device comprising a further concentric circle of gas filled cells each having a pair of transfer electrodes in contact with the discharge gas, the first transfer electrode of the pair for each cell being connected to, or comprising, one of the third conductors, and the second transfer electrode being connected to other second transfer electrodes to form groups of equal numbers, corresponding electrodes in each group being connected to a transfer conductor extending concentrically of the cells such that repetitive energisation of each transfer conductor in turn causes a discharge formed in one glow transfer cell to move around the circle by the mechanism of glow transfer changing the potential of each third conductor in turn to cause striking or extinguishing of discharges in cells of the first or second array addressed contemporaneously by way of the first or second conductors respectively.

2. A display panel as claimed in claim 1 in which the first array comprises a plurality of sub-arrays each formed by the crossing points of N first conductors and a unique group of n adjacent third conductors.

3. A display panel as claimed in claim 2 in which the groups of n third conductors are disposed symmetrically around the circular array.

4. A display panel as claimed in claim 1 in which the first conductors are arranged to be common to more than one row of sub-arrays.

5. A display panel as claimed in claim 1 in which the pairs of transfer electrodes are arranged to extend in substantially a complete circle, the first and last pairs of electrodes of the device being separated by a pair of reset electrodes and belonging to a different group from each other whereby the direction and time between glow transfer sweeps can be varied.

6. A display panel as claimed in claim 1 which the first conductors and associated electrodes and resistors of the first array, second conductors and associated electrodes and resistors of the second array and the second transfer electrodes of the glow transfer device are all formed on one face of a first end-plate of electrically insulating material adjacent said block of electrically insulating material and the third conductors, associated resistors and common conductor are formed on one face of a second end-plate of electrically insulating material adjacent said block of electrically insulating material.

7. A display panel as claimed in claim 1 in which all the second conductors are connected to each other.

* * * * *